United States Patent [19]

Brown et al.

[11] Patent Number: 4,580,724

[45] Date of Patent: Apr. 8, 1986

[54] IMPACT DRIVE SPRINKLER

[75] Inventors: Richard D. Brown, Glendora; Hans D. Christen, La Verne, both of Calif.

[73] Assignee: Rain Bird Sprinkler Mfg. Corp., Calif.

[21] Appl. No.: 352,322

[22] Filed: Feb. 25, 1982

[51] Int. Cl.[4] ..... B05B 3/04

[52] U.S. Cl. ..... 239/230; 239/233

[58] Field of Search ..... 239/225, 230, 231, 232, 239/233; 403/23

[56] References Cited

U.S. PATENT DOCUMENTS

| | | | |
|---|---|---|---|
| 2,160,121 | 5/1939 | Buckner | 239/230 |
| 2,310,796 | 2/1943 | Lappin | 239/230 |
| 2,606,789 | 8/1952 | Royer | 239/230 |
| 2,918,220 | 12/1959 | Crow . | |
| 2,981,482 | 4/1961 | Warren | 239/230 |
| 3,043,522 | 7/1962 | Ryerson | 239/230 |
| 3,080,123 | 3/1963 | Erns . | |
| 3,103,313 | 9/1963 | Raem . | |
| 3,193,203 | 7/1965 | Crow . | |
| 3,244,373 | 4/1966 | Hait . | |
| 3,350,015 | 10/1967 | Friedmann et al. | 239/230 |
| 3,912,171 | 10/1975 | Johnson | 239/230 |
| 3,957,205 | 5/1976 | Costa | 239/230 |
| 4,177,944 | 12/1979 | Wichman . | |

FOREIGN PATENT DOCUMENTS

| | | | |
|---|---|---|---|
| 97574 | 12/1963 | Denmark | 239/230 |
| 1107015 | 5/1961 | Fed. Rep. of Germany | 239/230 |
| 1480294 | 4/1967 | France | 239/233 |
| 350497 | 1/1961 | Switzerland | 239/230 |
| 1108442 | 4/1968 | United Kingdom | 239/230 |
| 1402608 | 8/1975 | United Kingdom | 239/233 |

*Primary Examiner*—Andres Kashnikow
*Assistant Examiner*—Daniel R. Edelbrock
*Attorney, Agent, or Firm*—Fulwider, Patton, Rieber, Lee & Utecht

[57] ABSTRACT

An impact drive sprinkler is provided for projecting a water stream in a generally upward and outward direction from a water supply riser. The sprinkler includes a sprinkler body formed from a length of tubing mounted for rotation on the riser wherein the tubing is bent at a selected angle to define a smooth, substantially uninterrupted flow path from the riser to a discharge nozzle. An impact drive assembly is mounted on the tubing and includes a spring-biased drive arm formed preferably from inexpensive stamped metal parts for interrupting the projected water stream at regular intervals and for impacting the tubing to rotate the tubing in increments about the riser. The drive assembly is mounted on the tubing at a position downstream from the tubing bend such that the construction and operation of the drive assembly is unaffected by the magnitude of the angular bend in the tubing.

13 Claims, 5 Drawing Figures

IMPACT DRIVE SPRINKLER

BACKGROUND OF THE INVENTION

This invention relates generally to impact drive sprinklers, and more particularly, to a simplified impact drive sprinkler constructed from relatively inexpensive components and having improved hydraulic flow characteristics.

Impact drive sprinklers in general are known in the art for use in applying irrigation water to crops, lawn areas, and the like. Such sprinklers typically include a sprinkler body mounted at the upper end of a water supply pipe or riser in a manner permitting rotation of the sprinkler body about the axis of the riser. A water flow path is formed within the sprinkler body for guiding a stream of water under pressure upwardly from the riser and then for turning the water stream in a generally outward and upwardly inclined direction for projection through a discharge nozzle. A spring-biased drive arm mounted on the sprinkler body is driven in an oscillatory manner by the projected water stream to impact the sprinkler body at a regular frequency for rotating the sprinkler body in small angular increments about the axis of the riser, whereby the projected water stream is swept over a circular region of soil for irrigation. If full circle rotation of the sprinkler body is not desired, the impact drive assembly can include a conventional reversing mechanism for periodically reversing the direction of rotation thereby permitting use of the sprinkler to irrigate within a selected arcuate region.

According to conventional manufacturing methods, the sprinkler body is formed from a rust-free or rust-resistant material such as brass or plastic by a casting or molding process wherein the material is poured or injected into a closed mold having an internal mold cavity conforming to the desired sprinkler body geometry. This type of manufacturing process, however, tends to be relatively costly, particularly with regard to the formation of the different molds for each sprinkler body configuration.

In a sprinkler body formed by casting or molding, the internal water flow path is typically defined by a pair of generally linear passages which intersect angularly with each other within the sprinkler body. These generally linear passages can be formed by use of internal cores which are positioned within the mold cavity prior to casting and then removed from the sprinkler body after it is separated from the mold. Alternatively, the generally linear passages can be formed by a drilling process. In either event, the intersecting passages form a relatively abrupt angular bend in the water flow path wherein the bend is not smoothly contoured for optimizing hydraulic flow with minimum turbulence. Instead, the bend is defined by a variety of surface irregularities, discontinuities, and interruptions which are inherent with the method of forming the intersecting passages. As a result, when sprinkler bodies of this general type are used, the water experiences substantial turbulence as it flows through the bend to reduce significantly the kinetic energy of the water stream projected from the discharge nozzle, thereby reducing correspondingly the range of the water stream and the soil area which can be irrigated. While this energy loss can be alleviated in part by the use of so-called straightener vanes positioned along the flow path immediately upstream of the nozzle, such straightener vanes increase the cost of the sprinkler and do not prevent at least some energy losses.

A further disadvantage encountered with conventional cast sprinkler bodies is that the spring-biased drive arm has a size and shape uniquely chosen to match a particular sprinkler body configuration. More specifically, the drive arm is typically mounted on the sprinkler body for oscillatory movement about the axis of the water supply riser and includes a deflector spoon shaped for appropriate interaction with a water stream having a particular trajectory. If it is desired, however, to manufacture an alternative sprinkler body wherein the trajectory of the projected water stream has a different angle of inclination, it is also necessary to manufacture an alternative drive arm shaped to match the new trajectory. Since these drive arms are normally manufactured by a casting or molding process, additional uniquely-shaped molds are required to thus further contribute significantly to the final cost of the sprinkler.

The present invention overcomes the problems and disadvantages of the prior art by providing an improved impact drive sprinkler wherein the sprinkler body is formed from an inexpensive length of tubing which is bent to a selected angle for projecting a water stream at a desired trajectory. Moreover, the tubular sprinkler body is adapted for use with a drive arm of substantially universal geometry regardless of the trajectory of the projected water stream, wherein the drive arm advantageously can be formed from inexpensive stamped metal parts.

SUMMARY OF THE INVENTION

In accordance with the invention, an impact drive sprinkler is provided having a sprinkler body formed from a length of tubing bent to a selected angle for projecting a water stream in a generally outward and upwardly inclined direction from a water supply riser. An impact drive assembly is mounted on the tubular sprinkler body and includes a drive arm for interrupting the water stream and impacting the sprinkler body to rotate the sprinkler body incrementally with respect to the riser.

In accordance with a preferred form of the invention, the sprinkler body is defined by a length of metal tubing having a relatively smoothly contoured bend formed therein at a selected angle generally intermediate its length. One end of the bent tubing comprises a water inlet end which extends downwardly through a journal bearing assembly adapted for connecting the water inlet end to the water supply riser in a manner accommodating rotation of the sprinkler body about the axis of the riser. The water inlet end tubing terminates within the riser with an outwardly flared flange to facilitate relatively smooth entry of water from the riser into the tubing. The tubing defines a smoothly contoured flow path of substantially uniform cross section for guiding the water flow upwardly to the tubing bend and for guiding the water flow through the bend relatively smoothly with minimum flow turbulence. From the bend, the water flows substantially linearly in a generally outward and upwardly inclined direction to a discharge end of the tubing for projection therefrom through a nozzle.

The impact drive assembly is mounted on top of the tubular sprinkler body at a position at least slightly downstream from the tubing bend therein. This drive assembly comprises a generally upstanding fulcrum pin coupled through a torsion spring to the drive arm which is in turn supported for rotation about the axis of the fulcrum pin. The fulcrum pin and the drive arm are oriented for movement of the drive arm within a plane generally parallel with the outwardly and upwardly inclined portion of the tubing such that the drive arm is positioned independently of the magnitude of the tubing bend. The drive arm is urged by the torsion spring to rotate in a direction bringing a stop tab into impact engagement with one side of the tubing to rotate the tubing through a relatively small angular increment about the axis of the riser. When this impact occurs, a deflector spoon unit carried by the drive arm interrupts the water stream which provides a driving force to rotate the drive arm against the torsion spring away from the water stream, whereupon the torsion spring eventually reverses the rotation of the drive arm back toward the tubing and once again impacts the tubing with the stop tab.

According to a preferred construction of the impact drive assembly, the drive arm including the deflector spoon unit and the stop tab are formed from relatively smooth-surfaced stamped metal parts. The fulcrum pin mounted on the tubing projects upwardly through a central opening in the drive arm and supports a bearing sleeve fixed to the drive arm to thus define an axis for drive arm rotation. The upper end of the fulcrum pin carries a multi-legged spider which supports one end of a helical torsion spring, and the opposite end of the torsion spring is supported by a plurality of locator tabs struck upwardly from the drive arm. The opposite ends of the torsion spring are turned radially inwardly toward the fulcrum pin for respective engagement with one of the spider legs and one of the tabs such that the magnitude of the torsional spring force can be adjusted by selecting the particular spider leg or tab engaged by the spring ends. A protective hood is fitted over the fulcrum pin, spider, and torsion spring wherein the hood has a plurality of latch fingers receivable through the holes in the drive arm created by formation of the upstruck tabs.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
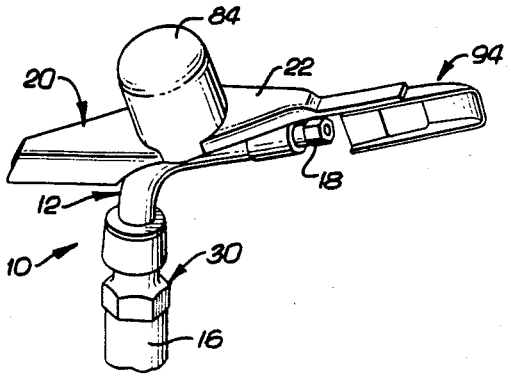
FIG. 1 is a perspective view illustrating an impact drive sprinkler embodying the novel features of this invention.

As shown in the exemplary drawings, the present invention is embodied in a new and improved impact drive sprinkler, designated generally by the reference numeral 10, of the type designed primarily for use in the irrigation of crops, lawn areas, and the like. The sprinkler 10 includes a simplified sprinkler body formed from a length of bent tubing 12 to define a smooth and substantially uninterrupted hydraulic flow path 14 for flow of water from a water supply pipe or riser 16 to a discharge nozzle 18. The water is projected in a stream through the nozzle 18 in a generally outward and upwardly inclined direction to irrigate a prescribed soil area. An impact drive assembly 20 is mounted on the tubular sprinkler body and includes a simplified drive arm 22 for interacting with the projected water stream and the sprinkler body to rotate the sprinkler body in a series of small angular increments about the riser thereby substantially increasing the soil area covered by the projected water stream.

The impact drive sprinkler 10 of this invention offers significant advantages when compared with conventional impact drive sprinklers available in the art. More specifically, the impact drive sprinkler 10 is constructed from inexpensive components which are bent or stamped to the desired configuration and then assembled quickly and easily to provide a highly economical sprinkler. The invention thus avoids use of relatively expensive cast or molded sprinkler components of the type commonly used in the art, particularly with regard to the sprinkler body and the drive arm. Moreover, the tubular sprinkler body defines a smooth-walled hydraulic flow path of substantially uninterrupted uniform cross section for guiding the water flow with minimum flow turbulence from the riser through the bend in the tubing 12 to the outwardly and upwardly inclined direction. This smooth water flow through the flow path 14 results in measurable increases in the kinetic energy of the water stream at the discharge nozzle thereby resulting additionally in substantial increases in the projected range of the water stream when compared with cast or molded prior art sprinkler bodies. The specific angle of inclination, or trajectory, of the projected water stream can be selected during the manufacturing process by simple adjustment of tube-bending apparatus (not shown), and the drive arm 22 is mounted on the tubing in a manner permitting a single drive arm geometry to be used with tubular sprinkler bodies having a range of angular bends therein.

Figure 2:
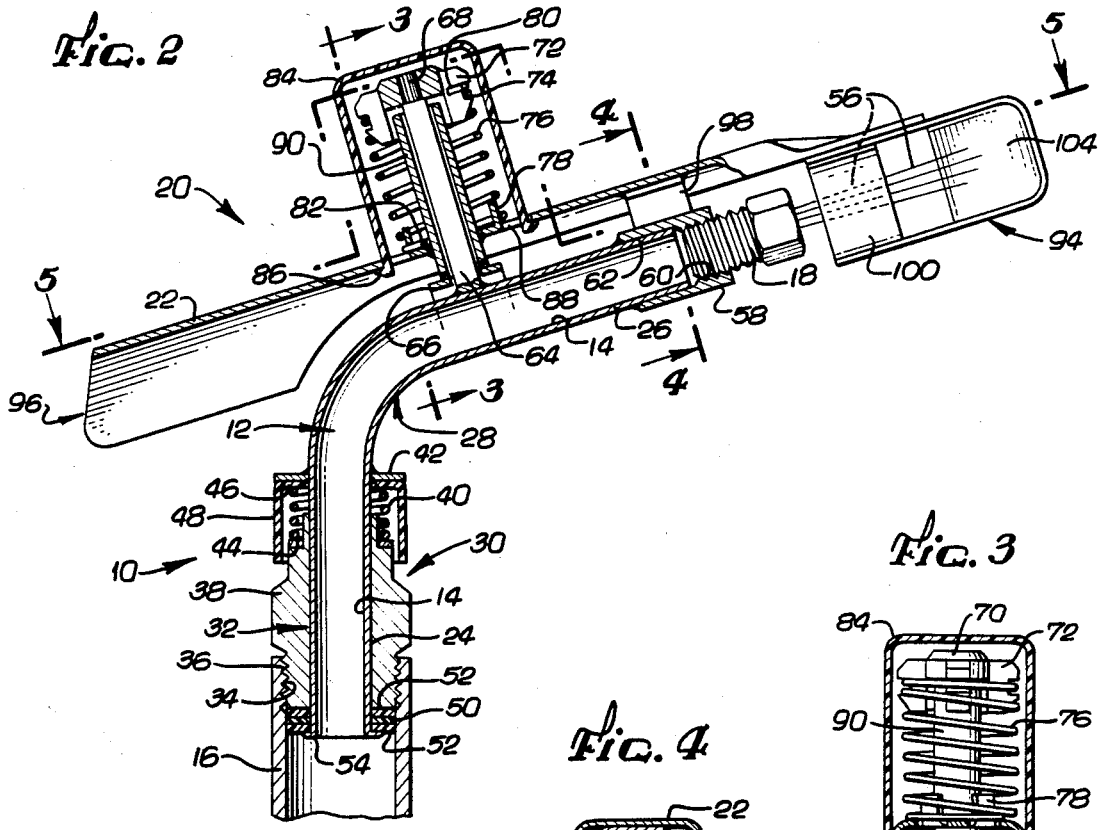
FIG. 2 is an enlarged elevation view showing the sprinkler primarily in vertical section.
Figure 3:
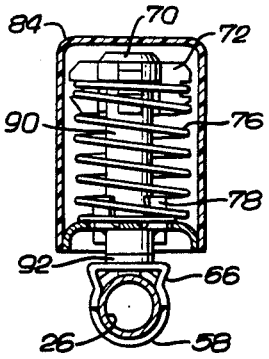
FIG. 3 is a generally vertical section of the sprinkler as viewed along the line 3—3 of FIG. 2.
Figure 4:
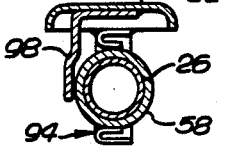
FIG. 4 is a generally vertical section of the sprinkler as viewed along the line 4—4 of FIG. 2.
Figure 5:
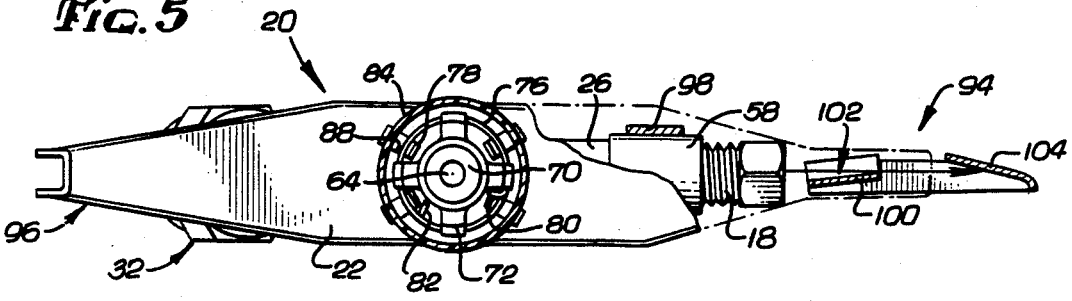
FIG. 5 is a generally top plan view of the sprinkler, shown partially in section, as viewed along the line 5—5 of FIG. 2.

With reference to FIGS. 1 and 2, the exemplary impact drive sprinkler 10 comprises a sprinkler body formed from a length of hollow tubing 12 having the flow path 14 formed therethrough. In accordance with a preferred form of the invention, the tubing 12 comprises a metal material which can be bent to a selected angular configuration—for example, stainless steel—by use of conventional tube-bending apparatus (not shown). The tubing is bent to a shape having generally linear lower and upper portions 24 and 26 disposed typically at an obtuse angle relation to each other and separated by a smoothly contoured bend, referred to in FIG. 2 by arrow 28. Importantly, after bending, the tubing flow path 14 has a substantially uniform cross-sectional shape which is bounded by the smooth-walled inner diameter surface of the tubing and, in the illustrative embodiment, is substantially uninterrupted throughout the length of the tubing.

The bent tubing 12 is mounted at the upper end of the upstanding water supply pipe or riser 16 through which water under pressure is supplied to the sprinkler. In this regard, this mounting is accomplished by a journal bearing assembly 30 carried about the lower portion 24 of the tubing 12. This journal bearing assembly 30 supports the tubing in a position with the upper portion 26 extending generally outwardly and upwardly with respect to the riser 16, and constrains the lower portion 24 for substantially leak-free rotational movement about the vertical axis of the riser 16.

The journal bearing assembly 30 is illustrated in detail in FIG. 2 and comprises a cylindrical coupling 32 of turned brass or the like carried about the lower portion 24 of the tubing 12. This coupling 32 includes a male threaded section 34 for threaded engagement with a female threaded upper end 36 of the riser 16 and a hex-head section 38 for convenient engagement by an appropriate wrench (not shown) to facilitate installation and removal of the sprinkler with respect to the riser. Alternatively, the male-female relationship of the threads on the coupling 32 and the riser 16 can be reversed, if desired.

The cylindrical coupling 32 is urged downwardly by a helical compression spring 40 received about the lower portion 24 of the tubing 12 at a position below the bend 28. This spring 40 reacts against a radially enlarged rib 42 such as a washer secured to the tubing by brazing or the like to apply an axially downward force to a wear washer 44 at the upper axial end of the coupling 32. Conveniently, as shown in FIG. 2, the spring 40 and the upper end of the coupling 32 are protected from contamination by contact with dirt, grit, or the like by an inverted protective cup which is received about the tubing 12 and has a base 46 trapped by the spring 40 against the underside of the fixed rib 42 and a skirt 48 depending from the base 46 to substantially enclose the spring.

The helical compression spring 40 thus urges the lower axial end of the coupling 32 into bearing engagement with a stack of seal washers, such as a relatively rigid nylon washer 50 sandwiched between a pair of elastomeric washers 52. As illustrated, these seal washers 50 and 52 are positioned about the lowermost end of the lower portion 24 of the tubing and are retained thereon by a radially enlarged or flared flange 54 at the inlet end of the sprinkler body. Accordingly, when the coupling 32 is threaded into the riser 16, the compression spring 40 maintains the stack of seal washers 50 and 52 in tightly compressed relation between the end of the coupling 32 and the upper face of the flared flange 54. By sizing the seal washers 50 and 52 to sealingly engage the inner diameter surface of the riser 16, water flow from the riser is confined to flow into the flow path 14 within the tubing substantially without leakage. Importantly, however, this leak-free connection accommodates rotation of the lower portion 24 of the tubing about the vertical axis of the riser.

The flared flange 54 on the tubing 12 is therefore positioned directly within the upper end of the riser 16 and provides a smoothly contoured water inlet geometry for guiding water under pressure with minimized flow turbulence upwardly into the flow path 14. The flow path 14 extends without significant surface interruption or discontinuities upwardly through the journal bearing assembly 30 toward the bend 28 in the tubing. The water is thus guided relatively smoothly for flow to and through the bend 28 without significant flow turbulence or resultant flow energy losses. The water thus passes through the bend 28 into and through the upper portion 26 of the tubing with a relatively high kinetic energy for projection from the sprinkler through the discharge nozzle 18.

The nozzle 18 is secured to the discharge end of the upper portion 26 of the tubing 12 in an appropriate manner and defines an outlet orifice of selected size and shape through which the water is projected in the form of a stream 56 for irrigation purposes. While a variety of constructions are available for securing the nozzle 18 to the tubing, one preferred form is illustrated in FIG. 2 and advantageously accommodates use of interchangeable standardized nozzles having male threads for quick and easy reception into complementary-shaped female threads at the discharge end of the sprinkler. To accommodate a nozzle of this type, the sprinkler 10 of this invention includes a cylindrical mounting collar 58 having internal female threads 60 at one end for receiving the nozzle 18 and a smooth-walled inner diameter surface 62 at its opposite end for relatively close sliding reception onto the discharge end of the tubing upper portion 26. The mounting collar 58 is fixed to the tubing by brazing or the like to provide a permanently mounted receptacle for the nozzle.

The projected water stream 56 is swept over a relatively broad soil surface area to maximize the irrigation coverage of the sprinkler by rotating the tubing 12 about the axis of the riser 16. This rotation is achieved by operation of the impact drive assembly 20 which is mounted on top of the upper portion 26 of the tubing 12 at a position generally between the bend 28 and the discharge nozzle 18. This drive assembly 20, as illustrated in detail in FIGS. 2–5, includes a fulcrum pin 64 secured as by brazing to an inverted, generally U-shaped mounting bracket 66 which is in turn secured as by brazing to the tubing 12. From the mounting bracket 66, the fulcrum pin 64 projects in an upward direction generally perpendicular to the inclined upper portion 26 of the tubing to pass through the drive arm 22 and terminates at its upper end in a knurled tip 68.

A multi-legged spider 70 is received tightly over the knurled tip 68 such that the spider 70 is fixed against rotation with respect to the fulcrum pin 64. As illustrated, the spider 70 includes a plurality of radially outwardly projecting legs 72, each extending downwardly a short distance toward the drive arm 22 and including an outwardly presented recess 74 for receiving the upper wrap of a helical torsion spring 76. The spider legs 72 thus provide a centering means for the upper extent of the torsion spring 76 which in turn projects downwardly therefrom and has its lower extent centered about a plurality of small tabs 78 struck upwardly from the drive arm 22. Importantly, the upper and lower ends 80 and 82 of the torsion spring 76 are turned radially inwardly toward the fulcrum pin 64, as viewed best in FIG. 5, to engage respectively one spider leg 72 and one tab 78 such that the spring 76 transmits a rotational torque between the spider 70 and the drive arm 22 in a direction urging the drive arm to rotate into impact engagement with the upper portion 26 of the tubing, as will be described in more detail.

The magnitude of the spring torque is selected and easily adjusted by manually releasing the spring 76 from the spider 70 to allow appropriate winding or unwinding of the spring 76 about its own axis prior to reconnecting the spring 76 to the spider. When the desired torque is set, a protective hood 84 of lightweight plastic or the like is fitted over the torsion spring 76 and the fulcrum pin 64 to prevent substantial contact thereof with dirt, grit, or the like. Conveniently, the hood 84 is fastened to the drive arm 22 by a plurality of depending latch fingers 86 which extend through openings 88 vacated by the upstruck tabs 78 for engagement with the underside of the drive arm.

The illustrated drive arm 22 is advantageously constructed from an inexpensive and lightweight material such as stamped sheet metal or the like and is supported for relatively smooth rotational movement with respect to the fulcrum pin 64. This rotational movement is facilitated by use of a bearing spacer sleeve 90 carried about the fulcrum pin and secured to the drive arm by brazing or the like, with a wear washer 92 being interposed between the spacer sleeve 90 and the mounting bracket 62, if desired. From the fulcrum pin 64, the drive arm 22 extends in a generally forward direction for connection to a deflector spoon unit 94 and in a generally rearward direction terminating in an enlarged counterbalance portion designated generally by the arrow 96 in FIG. 2. Importantly, the torque applied to the drive arm 22 by the torsion spring 76 urges the forward end of the drive arm to pivot about the fulcrum pin 64 in a direction moving the deflector spoon unit 94 to a position in front of the nozzle 18 interrupting the projected water stream 56.

The above-described rotational movement of the drive arm 22 is limited by a stop tab 98 which depends from the drive arm to engage or impact one side of the sprinkler. More particularly, this stop tab 98 is formed from stamped sheet metal or the like for convenient connection to the drive arm as by spot welding to project downwardly from the drive arm for impact engagement with one side of the nozzle mounting collar 58. When this impact occurs, a lateral force is imparted to the discharge end of the tubing 12 to rotate the tubing through a relatively small angular increment about the axis of the riser 16. Such rotation thus redirects slightly the azimuth of the projected water stream.

The deflector spoon unit 94, which is also formed from stamped sheet metal for convenient connection to the drive arm as by spot welding or the like, moves to the position generally in front of the nozzle 18 for interaction with the water stream as the stop tab 98 moves into engagement with the mounting collar 58. More particularly, as viewed in FIGS. 2 and 5, the deflector spoon unit 94 moves an upstanding vane 100 in front of the nozzle 18 wherein this vane is set at a slight angle with respect to the projected direction of the water stream. As the vane 100 moves through the water stream, the stream engages the backsurface 102 of the vane to draw the entire deflector spoon unit 94 further into the water stream until the stop tab 98 impacts the mounting collar 58. When this impact occurs, the water stream flows behind the vane 100 and strikes an oppositely angled spoon 104 at the front of the deflector spoon unit 94, as viewed in FIG. 5. The water stream thus imparts a substantial lateral force to the spoon 104 to rotate the drive arm 22 out of the water stream against the force of the torsion spring 76. The torsion spring 76 eventually dissipates the hydraulic force applied to the drive arm and thereupon reverses the rotation of the drive arm back toward interruption with the water stream and impact engagement of the stop tab 98 with the mounting collar 58. In this manner, the tubing 12 is rotated successively in relatively small angular increments through a full circle rotation about the axis of the riser 16. However, if desired, an appropriate reversing mechanism of the type typically used in impact drive sprinklers can be provide to limit the tubing 12 to rotation within a selected arcuate path.

According to one feature of the invention, the above-described mounting arrangement for the impact drive assembly 20 is independent of the magnitude of the angular bend 28 in the tubing, thereby allowing the drive assembly to be used without modification with any of a range of sprinklers having different angular tubing bends 28 to provide different trajectories for the water streams. More particularly, the drive assembly 20 is mounted on top of the upper portion 26 of the tubing 12 to position the drive arm 22 for oscillatory movement substantially parallel to the upper portion 26, irrespective of the particular angle of inclination of the upper portion 26. Moreover, by mounting the fulcrum pin 64 at a position at least slightly downstream from the tubing bend 28, the total moment arm acting about the axis of the riser 16 is increased to correspondingly increase the effective rotational force applied to the tubing 12 by the stop tab 98. This effective force increase advantageously results in relatively faster sprinkler rotation times and movement through rotational increments of greater magnitude which can be particularly desirable when water supply pressure is relatively low.

The impact drive sprinkler of this invention offers further significant improvements over conventional sprinklers having cast or molded sprinkler bodies in that the water flow into and through the sprinkler is significantly smoother with substantially reduced flow turbulence, particularly at the bend 28. The flow path 14 has a smooth inlet end defined by the flared flange 54 and extends without significant surface interruption through the journal bearing assembly 30, through the bend 28, to the discharge nozzle 18. The cross-sectional size and shape of the flow path, together with the surface texture of the tubing walls bounding the flow path, are substantially uniform throughout. As a result, the water stream has a higher kinetic energy when it reaches the discharge nozzle 18, wherein this increased kinetic energy level translates directly into an increased range of throw of the projected water stream of about 10 percent or greater when compared with conventional cast brass or molded plastic sprinkler bodies.

The present invention is further advantageous in that the major components thereof can be constructed from inexpensive components which are easily produced in the desired final configuration by use of economical, high volume manufacturing processes. In particular, the tubing 12 can be bent to the final desired shape, and the stamped drive arm 22, including the deflector spoon unit 94, can be manufactured to close tolerances quickly and in high volume without the use of expensive molds or the like. When assembled, the resultant sprinklers exhibit a high level of reproducibility with respect to each other while at the same time providing both reliability and low cost.

A variety of modification and improvements to the impact drive sprinkler described herein are believed to be apparent to one skilled in the art. Accordingly, no limitation on the invention is intended, except as set forth in the appended claims.

What is claimed is:

1. An impact drive sprinkler for connection to a water supply riser, comprising:

a sprinkler body formed from a length of tubing having a bend generally intermediate its length separating first and second tubing portions disposed angularly with respect to each other, said tubing defining an open flow path for passage of water therethrough;

a journal bearing assembly carried about said first tubing portion for connecting said first tubing portion to the riser with said flow path disposed for flow thereinto of water from the riser, whereby the water flows through said tubing for discharge as a projected water stream from said second tubing portion, said journal bearing assembly including means for permitting rotation of said tubing generally about the axis of the riser; and an impact drive assembly mounted on said second tubing portion for impacting one side of said second tubing portion at a regular frequency to cause rotation of said tubing in a succession of angular increments generally about the axis of the riser, said drive assembly including a fulcrum pin mounted on said second tubing portion to project generally perpendicularly with respect thereto in a direction generally away from said first tubing portion, a drive arm mounted on said fulcrum pin for oscillatory movement within a plane generally parallel to said second tubing portion, a stop tab on said drive arm for impacting one side of said second tubing portion, a torsion spring coupled between the distal end of said fulcrum pin and a plurality of locator tabs formed on said drive arm for urging said drive arm to rotate in a direction bringing said stop tab into impact engagement with said second tubing portion, a protective hood fitted over said fulcrum pin and torsion spring and connected to said drive arm, and a deflector spoon unit on said drive arm for interrupting the projected water stream substantially simultaneously with said impact engagement whereby the water stream imparts a force to said drive arm to rotate said drive arm against said torsion spring;

said drive arm being formed from a metal stamping and said locator tabs being struck upwardly from said drive arm, said hood including latch fingers receivable downwardly through holes in said drive arm vacated by said locator tabs.

2. The impact drive sprinkler of claim 1 wherein said first tubing portion extends generally linearly from said bend through said journal bearing assembly and terminates with a radially outwardly flared flange defining a relatively smoothly contoured water inlet for guiding water flow from the riser into said tubing flow path with minimum flow turbulence;

said journal bearing assembly comprising a generally cylindrical coupling rotationally and axially slidably carried about said first tubing portion for connection to the riser, at least one seal ring interposed between said flared flange and one axial end of said coupling, outwardly projecting rib means on said first tubing portion between said bend and the opposite axial end of said coupling, and biasing means for reacting between said coupling and said rib means for urging said flared flange on said first tubing portion into sealed engagement with said at least one seal ring.

3. The impact drive sprinkler of claim 2 including a cup member having a base carried about said first tubing portion between said rib means and said biasing means, and a protective annular skirt extending from said base in a direction surrounding said biasing means.

4. The impact drive sprinkler of claim 1 wherein said first and second tubing portions are disposed generally at an obtuse angle with respect to each other.

5. The impact drive sprinkler of claim 1 wherein said flow path defined by said tubing extends through said first tubing portion, said bend, and said second tubing portion without substantial surface interruption.

6. The impact drive sprinkler of claim 1 wherein said flow path defined by said tubing has a substantially uniform cross-sectional size and shape extending through said first tubing portion, said bend, and said second tubing portion.

7. The impact drive sprinkler of claim 1 wherein said tubing comprises a length of metal having said bend formed therein to orient said first and second tubing portions at a selected angle with respect to each other.

8. The impact drive sprinkler of claim 1 wherein said second tubing portion extends generally linearly from said bend and terminates with an open end through which water flowing through said flow path is discharged, and including a discharge nozzle mounted at the open end of said second tubing portion.

9. The impact drive sprinkler of claim 8 including a mounting collar carried about the open end of said second tubing portion and having means for removably supporting said discharge nozzle.

10. An impact drive sprinkler for connection to a water supply riser, comprising:

a sprinkler body formed from a length of tubing having a bend therein separating first and second tubing portions disposed angularly with respect to each other, said tubing defining an open flow path having a substantially uniform cross-sectional size and shape substantially throughout its length for passage of water with minimum flow turbulence;

a journal bearing assembly carried about said first tubing portion for connecting said first tubing portion to the riser with said flow path disposed for flow thereinto of water from the riser whereby the water flows through said tubing for discharge as a projected water stream from said second tubing portion, said journal bearing assembly including means for permitting rotation of said tubing generally about the axis of the riser; and an impact drive assembly for rotating the tubing about the riser in a succession of relatively small angular increments, said drive assembly including a drive arm mounted for oscillatory movement within a plane generally parallel to said second tubing portion, a stop tab on said drive arm for impacting one side of said second tubing portion, a torsion spring for urging said drive arm to rotate in a direction bringing said stop tab into impact engagement with said second tubing portion to rotate said tubing through a relatively small angular increment, and a deflector spoon unit on said drive arm for interrupting the projected water stream substantially simultaneously with said impact engagement whereby the water stream imparts a force to said drive arm to rotate said drive arm against said torsion spring;

said impact drive assembly further including a fulcrum pin mounted on said second tubing portion to project generally perpendicular with respect thereto through said drive arm in a direction generally away from said first tubing portion, said torsion spring being coupled between the distal end of said fulcrum pin and a plurality of locator tabs formed on said drive arm, and further including a protective hood fitted over said fulcrum pin and torsion spring and connected to said drive arm;

said drive arm being formed from a metal stamping and said locator tabs being struck upwardly from said drive arm, said hood including latch fingers receivable downwardly through holes in said drive arm vacated by said locator tabs.

11. The impact drive sprinkler of claim 10 wherein said first tubing portion has a free end formed with a radially outwardly flared flange contoured for relatively smooth flow of water into said flow path;

said journal bearing assembly comprising a generally cylindrical coupling rotationally and axially slidably carried about said first tubing portion for connection to the riser, at least one seal ring interposed between said flared flange and one axial end of said coupling, outwardly projecting rib means on said first tubing portion between said bend and the opposite axial end of said coupling, and biasing means for reacting between said coupling and said rib means for urging said flared flange on said first tubing portion into sealed engagement with said at least one seal ring.

12. The impact drive sprinkler of claim 11 including a cup member having a base carried about said first tubing portion between said rib means and said biasing means, and a protective annular skirt extending from said base in a direction surrounding said biasing means.

13. The impact drive sprinkler of claim 10 wherein said tubing comprises a length of metal having said bend formed therein to orient said first and second tubing portions at a selected angle with respect to each other.

* * * * *